US011615699B2

(12) United States Patent
Penney

(10) Patent No.: US 11,615,699 B2
(45) Date of Patent: Mar. 28, 2023

(54) SMOKE DETECTOR AVAILABILITY TEST

(71) Applicant: Tyco Fire & Security GmbH, Neuhausen am Rheinfall (CH)

(72) Inventor: Stephen John Penney, Feltham (GB)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 538 days.

(21) Appl. No.: 16/606,306

(22) PCT Filed: Apr. 20, 2018

(86) PCT No.: PCT/EP2018/060175

§ 371 (c)(1),
(2) Date: Oct. 18, 2019

(87) PCT Pub. No.: WO2018/193086

PCT Pub. Date: Oct. 25, 2018

(65) Prior Publication Data

US 2022/0058939 A1 Feb. 24, 2022

Related U.S. Application Data

(60) Provisional application No. 62/487,524, filed on Apr. 20, 2017.

(51) Int. Cl.
*G08B 29/14* (2006.01)
*G08B 17/107* (2006.01)

(52) U.S. Cl.
CPC ..... *G08B 29/145* (2013.01); *G08B 17/107* (2013.01)

(58) Field of Classification Search
CPC ..... G08B 17/113; G08B 17/00; G08B 17/10; G08B 7/062; G08B 29/185; H01M 2/1055
See application file for complete search history.

(56) References Cited

U.S. PATENT DOCUMENTS 3,693,401 A * 9/1972 Purt ..... B65D 83/28 73/1.05
5,596,314 A * 1/1997 Goldstein ..... H01M 50/213 429/96
5,859,706 A * 1/1999 Nagashima ..... G08B 29/145 356/438
6,288,637 B1 * 9/2001 Thomas ..... G08B 17/00 340/505
8,004,416 B2 * 8/2011 Bradley, Jr. ..... G08B 17/10 340/693.6

(Continued)

FOREIGN PATENT DOCUMENTS

GB 2 543 065 A 4/2017
WO WO 2017060716 4/2017

OTHER PUBLICATIONS

International Preliminary Repont on Patentability, dated Oct. 31, 2019, from International Application No. PCT/EP2018/060175, filed on Apr. 20, 2018. 7 pages.

(Continued)

*Primary Examiner* — Curtis J King
(74) *Attorney, Agent, or Firm* — Arentfox Schiff LLP

(57) ABSTRACT

The present invention relates to a system for testing the availability of a detector for detecting smoke. More specifically, the present invention relates to a detector with a testing unit arranged to detect whether the detector has been covered, such that it is unable to perform its function as a smoke detector.

13 Claims, 1 Drawing Sheet

(56) References Cited

U.S. PATENT DOCUMENTS 8,760,280 B2 * 6/2014 Piccolo, III ..... G08B 17/00 340/506
10,181,244 B1 * 1/2019 Grady ..... G01J 5/026
2005/0217872 A1 * 10/2005 Oh ..... G08B 25/08 169/68
2007/0001865 A1 * 1/2007 Rowe ..... G08B 17/10 340/628
2008/0314602 A1 * 12/2008 Lohnes ..... A62C 13/78 169/56
2010/0315224 A1 * 12/2010 Orsini ..... G08B 29/126 340/506
2013/0286391 A1 * 10/2013 Erdtmann ..... G08B 17/107 250/338.5
2014/0015668 A1 * 1/2014 Hanses ..... G08B 29/24 340/630
2014/0333928 A1 * 11/2014 Erdtmann ..... G08B 17/107 356/338
2015/0103346 A1 * 4/2015 Erdtmann ..... G08B 17/107 356/338
2015/0213699 A1 * 7/2015 Bell ..... G01J 5/0896 250/338.1
2015/0302727 A1 * 10/2015 Piccolo, III ..... G08B 17/107 340/514
2015/0346086 A1 * 12/2015 Erdtmann ..... G01N 21/274 250/574
2017/0091998 A1 * 3/2017 Piccolo, III ..... G08B 17/10
2018/0012482 A1 * 1/2018 Brown ..... G08B 29/145
2020/0035088 A1 * 1/2020 Penney ..... G08B 29/145
2021/0158686 A1 * 5/2021 Lang ..... G08B 17/06
2021/0396728 A1 * 12/2021 Dall'Omo ..... G08B 26/006

OTHER PUBLICATIONS

International Search Report of the International Searching Authority, dated Jul. 12, 2018, from International Application No. PCT/EP2018/060175, filed on Apr. 20, 2018. 3 pages.
Written Opinion of the International Searching Authority, dated Jul. 12, 2018, from International Application No. PCT/EP2018/060175, filed on Apr. 20, 2018. 5 pages.

* cited by examiner

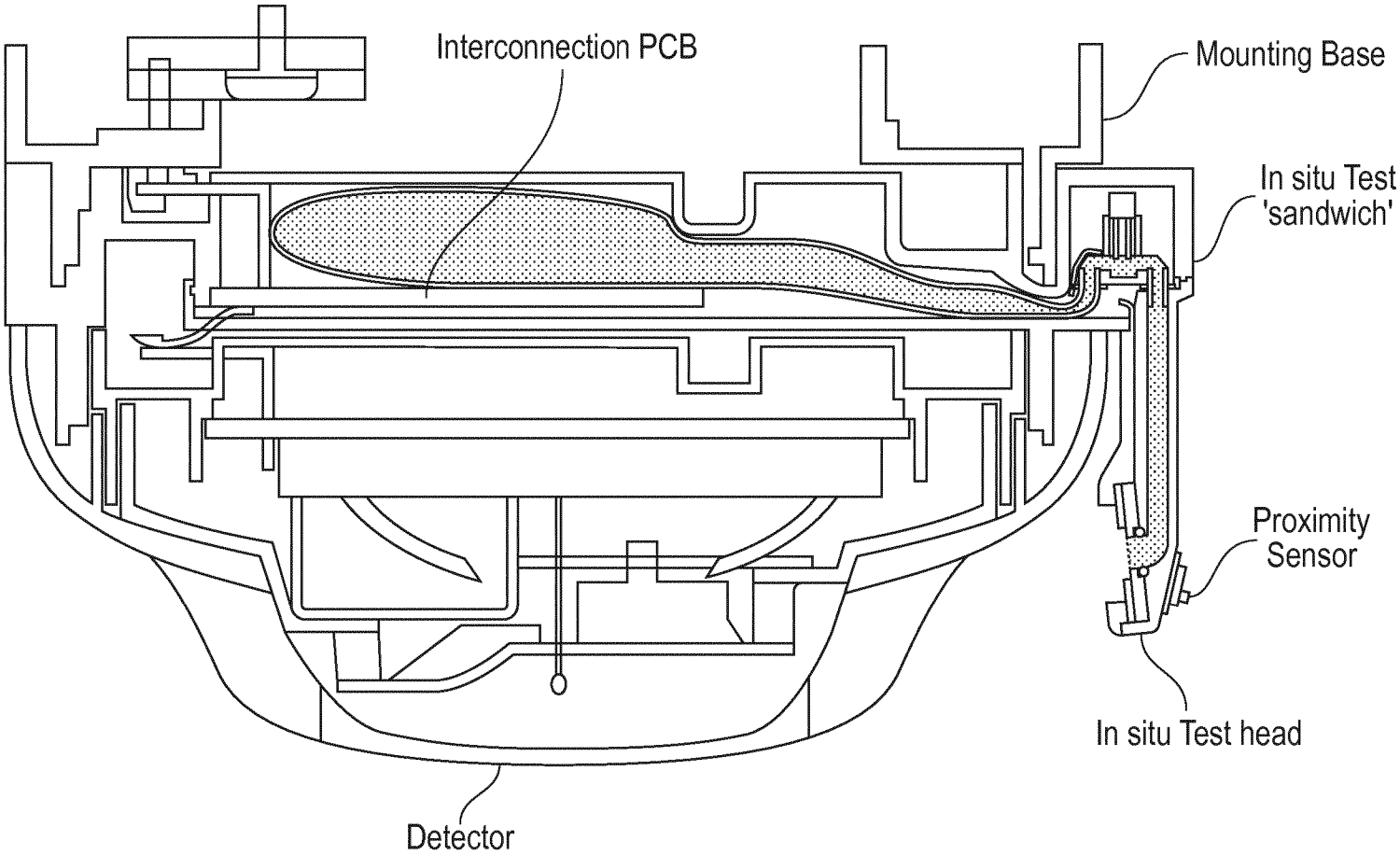
Mounting Base
In situ Test 'sandwich'
Proximity Sensor
In situ Test head
Interconnection PCB
Detector

SMOKE DETECTOR AVAILABILITY TEST

RELATED APPLICATIONS

This application is a § 371 National Phase Application of International Application No. PCT/EP2018/060175, filed on Apr. 20, 2018, now International Publication No. WO 2018/193086 A1, published on Oct. 25, 2018, which International Application claims the benefit under 35 USC 119(e) of U.S. Provisional Application No. 62/487,524, filed on Apr. 20, 2017, both of which are incorporated herein by reference in their entirety.

Smoke detectors are subject to regular tests and modern smoke detectors monitor internally that they remain operable. However, detectors are often in position for considerable periods and building redecorations, refurbishments, or other works that could generate false alarms may take place while they are installed. When this happens, the building manager may well take precautions to protect the site from false alarms and the detector from being compromised by paint, dust etc. Often this protection consists of taping or attaching a plastic bag over the detector to prevent the ingress of contaminants. This may serve the purpose well, but it also prevents the ingress of smoke if there were a fire.

The practice of covering the detector to protect it may be acceptable for very short periods, but if building works continue for a long period after the initial 'dirty' work is completed it is unlikely that the detector would be uncovered, thus compromising the safety of the site.

Presently, in order to check whether detectors are covered, a visual assessment is required. In this manner, an engineer performing the assessment must walk around a protected site and perform a visual assessment for each individual detector which is part of a system. This method of checking the availability of detectors has been long used in the industry of fire detection and is generally accepted as the best known method.

In an embodiment of the invention, there is provided a smoke detector test system, comprising: a fire alarm control panel; a smoke detector in communication with the fire alarm control panel; a test unit integral or immediately adjacent to the smoke detector for detecting an obstruction that has been placed over the smoke detector, the test unit providing a signal to the fire alarm control panel indicating if the detector is unavailable to detect smoke. This test unit detects the protection that has been placed over the detector, e.g., a bag, tape, dust over, etc., and signals back to a fire alarm control panel that the detector is unavailable to detect fire.

The test unit may comprise an assembly that plugs directly into the detector's existing base. This provides a proximity sensor means to identify an obstruction in the immediate vicinity of the detector. This may also be combined with an in situ detector test means for producing a test aerosol. The combination of the longer clearing time of the aerosol from the detector and the activation of the proximity sensor would give a good indication that the detector is covered in a way that would prevent smoke access.

The description below covers a proposed approach; but the main focus is the application of this technique for smoke detector availability detection and not the principle of generation of proximity sensing, or mechanics of doing this, although suggested embodiments are provided:

- The use of proximity sensor as a detector availability test apparatus
- The use of proximity sensor to initiate a secondary in situ detector tester to validate smoke entry (or exit)

- The combination of test aerosol persistence in the detector chamber from an in situ detector tester and proximity sensor output to determine that detector air entry has been compromised.

In at least one embodiment, the test unit may be an integral part of the in situ aerosol detector and may comprise a proximity sensor that may be a combination of one or more of, but not limited to, several technologies, including capacitive, ultrasonic and/or optical.

The smoke detector may also be powered from a detection loop, the test unit further comprising a proximity sensor, the proximity sensor operating a test cycle utilizing power from the detection loop.

The test unit may be an in situ detector test module which is sandwiched between the detector and the detector's mounting base.

BRIEF DESCRIPTION OF THE DRAWINGS

Other advantages and benefits of embodiments of the present invention will become apparent from a consideration of the following description and accompanying drawings, in which:

FIG. 1 shows a structural view of the present invention.

DETAILED DESCRIPTION

In a first embodiment in accordance with FIG. 1, there is provided a detector mounted on a mounting base. The detector is provided with a chamber arranged to allow ingress of particulates, such that smoke may be detected. The detector is also be provided with a test unit, arranged to test whether the detector is compromised. The test unit comprises a proximity sensor. The proximity sensor is located on an outer surface of the detector. The proximity sensor is driven by a controller. The controller can be a part of the test unit or a part of the detector. The proximity sensor is arranged to detect the presence of objects in the immediate vicinity of the detector. In this manner, should an object, such as a bag, be placed over the detector, the proximity sensor detects the object and the controller sends a signal to the fire alarm control panel indicating that an object has been detected. Alternatively, the controller sends a signal to the detector which, in turn, sends a signal to the fire alarm control panel indicating that an object has been detected.

In order that the proximity sensor does not produce a false notification of the detector being covered, the controller sends a signal to the fire alarm control panel only after a certain amount of time (a threshold time) has elapsed. For example, the threshold time may be five seconds, in order that objects passing by the detector do not trigger a false notification. Alternatively, the threshold time may be 1 hour, in order that the detector can be temporarily protected during redecoration of a room etc. without triggering a false notification. In this manner, the threshold time may be one of a variety of possible times depending on the situational requirements. The threshold time may be determined and/or altered, by a user, from the fire alarm control panel or, alternatively, may be predefined by a manufacturer of the detector.

In the first embodiment, the detector further comprises an in situ aerosol tester, as part of the test unit. The aerosol tester may be of a type as described in PCT publication no. WO/2017/060716. In this embodiment, the proximity sensor and the in situ detector are driven from the tester electronics (the controller), but would normally operate more frequently than the aerosol tester. The aerosol tester can be used to confirm the presence of a cover, as a result of a signal from the proximity sensor. If the presence of a cover over the detector is indicated by the proximity sensor, the controller may temporarily isolate the detector from communication with the fire control panel. Once the detector is isolated, the aerosol tester can be used to perform an in situ aerosol test, and finally indicate the result back via the normal (or other) communication route. If the aerosol test indicates that a testing fluid used in the test persists for longer than a threshold time, then it can be determined that the egress of particulates from the chamber has been compromised. From this, it can be inferred that the ingress of particulates into the chamber of the detector has also been compromised. Specifically, in combination with the signal from the proximity sensor, it can be determined that a cover has been placed over the detector.

In a second embodiment, the test unit comprises only a proximity sensor, without an in situ aerosol tester. In a similar manner to above, the proximity sensor is arranged to detect the presence of objects in the immediate vicinity of the detector. Should an object, such as a bag, be placed over the detector, the proximity sensor detects the object and the controller sends a signal to the fire alarm control panel indicating that an object has been detected. Alternatively, the controller sends a signal to the detector which, in turn, sends a signal to the fire alarm control panel indicating that an object has been detected.

In a third embodiment, the test unit comprises only an in situ aerosol tester, without a proximity sensor. In a similar manner to above, when performing an aerosol test, the persistence of a testing fluid within the chamber of the detector can be used to indicate that the detector has been covered. In this manner, if the detector, when being tested, indicates that smoke is present in the chamber for a period of time which exceeds a threshold time, then it can be determined that egress of smoke from the chamber, or generally away from the detector, is inhibited. As such, it can be inferred that ingress of smoke into the chamber is also inhibited.

In embodiments comprising a proximity sensor, the proximity sensor is located in any position on the outer surface of the detector. For example, as shown in FIG. 1, the sensor is located on the head of the aerosol tester. In this manner, the sensor is capable of determining that the detector is covered, even if the aerosol tester is capable of performing a test. In an alternative embodiment, the proximity senor may be placed elsewhere on the outer surface of the detector. For example, the sensor may be located close to an entry point of the chamber, so as to only produce a signal if the entry point of the chamber is covered. This reduces the chance of a false notification if an external area of the detector is covered in such a manner that particulates are still capable of entering the chamber of the detector.

The way that the detector is isolated and the exact control of the test would depend on the communication protocol utilized by the fire detection system used. Within a suggested embodiment there is an existing in situ detector test module which is in the form of a 'sandwich' component between the detector and the mounting base. All electrical connections may go through this component, as such it would be able to temporarily suspend communication between the detector and the fire control panel and communicate with the panel directly to enable the generation of a fault/trouble signal, or indicate that a test is in progress and the panel should not generate an alarm from that detection point.

On a regular schedule (for example, daily), either determined by an on board clock, or by signaling from the panel, the proximity sensor may operate its test cycle utilizing power from the detection loop. Although there would be a noticeable current draw from the test, if this were under panel control it can be ensured that only a limited number of tests would be performed simultaneously on any given loop.

Features of the present invention are defined in the appended claims. While particular combinations of features have been presented in the claims, it will be appreciated that other combinations, such as those provided above, may be used.

The invention claimed is:

1. A smoke detector test system, comprising:

a fire alarm control panel;

a smoke detector in communication with the fire alarm control panel; and a test unit integral or immediately adjacent to the smoke detector, wherein the test unit comprises an in situ aerosol tester, wherein the system is arranged to detect an obstruction that has been placed over the smoke detector by the test unit performing an in situ aerosol test of the smoke detector and by testing egress of the aerosol by the smoke detector detecting the persistence of the aerosol, the test unit providing a signal to the fire alarm control panel indicating if the detector is unavailable to detect smoke when an obstruction is detected.

2. The system of claim 1, wherein the test unit comprises an assembly that plugs directly into an existing base of the smoke detector.

3. The system of claim 1, wherein, in response to detecting an obstruction, the test unit is arranged to isolate the smoke detector from the fire alarm control panel and perform an in situ aerosol test.

4. The system of claim 1, wherein the test unit provides the signal to the fire alarm control panel if the detector is unavailable for a time period which exceeds a threshold time.

5. The system of claim 1, wherein the test unit is arranged to isolate the detector from the fire control panel in response to a determination that the detector is unavailable to detect smoke.

6. A smoke detector test system, comprising:

a fire alarm control panel;

a smoke detector in communication with the fire alarm control panel; and a test unit integral or immediately adjacent to the smoke detector for detecting an obstruction that has been placed over the smoke detector, the test unit providing a signal to the fire alarm control panel indicating if the detector is unavailable to detect smoke, wherein the test unit comprises a proximity sensor, external to a test chamber of the smoke detector and an in-situ aerosol tester to confirm the presence of the obstruction.

7. The system of claim 6, wherein test unit comprises an assembly that plugs directly into an existing base of the smoke detector.

8. The system of claim 6, wherein, in response to detecting an obstruction, the test unit is arranged to isolate the smoke detector from the fire alarm control panel and the in-situ aerosol testers performs an in situ aerosol test on the smoke detector.

9. The system of claim 6, wherein the smoke detector is powered from a detection loop, the proximity sensor operating a test cycle utilizing power from the detection loop.

10. The system of claim 6, wherein the proximity sensor is a combination of at least one or more of the following technologies: capacitive, ultrasonic and/or optical.

11. The system of claim 6, wherein the test unit is sandwiched between the detector and a mounting base of the detector.

12. The system of claim 6, wherein the test unit provides the signal to the fire alarm control panel if the detector is unavailable for a time period which exceeds a threshold time.

13. The system of claim 6, wherein the test unit is arranged to isolate the detector from the fire control panel in response to a determination that the detector is unavailable to detect smoke.

* * * * *